United States Patent [19]

Murayama et al.

[11] Patent Number: 5,076,086

[45] Date of Patent: Dec. 31, 1991

[54] THREAD ROLLING APPARATUS

[75] Inventors: Kimimasa Murayama; Shoji Ikawa; Shuhei Noro, all of Aichi, Japan

[73] Assignee: Toyota Jidosha Kabushiki Kaisha, Aichi, Japan

[21] Appl. No.: 336,513

[22] Filed: Apr. 11, 1989

Related U.S. Application Data

[63] Continuation of Ser. No. 45,201, May 4, 1987, abandoned, which is a continuation of Ser. No. 762,397, Aug. 5, 1985, abandoned.

[30] Foreign Application Priority Data

Aug. 22, 1984 [JP] Japan ..... 59-174682

[51] Int. Cl.[5] ..... B21H 3/06

[52] U.S. Cl. ..... 72/88

[58] Field of Search ..... 72/88, 90, 103, 108, 72/469

[56] References Cited

U.S. PATENT DOCUMENTS

| | | | |
|---|---|---|---|
| 408,529 | 8/1889 | Rogers | 72/88 |
| 408,530 | 8/1889 | Rogers | 72/88 |
| 408,673 | 8/1889 | Rogers | 72/88 |
| 411,480 | 9/1889 | Warren | 72/88 |
| 1,940,367 | 12/1933 | Nagel | 72/90 |
| 3,914,083 | 10/1975 | Arai | 72/103 |
| 4,155,237 | 5/1979 | Jungesjo | 72/88 |

FOREIGN PATENT DOCUMENTS

| | | | |
|---|---|---|---|
| 68143 | 5/1980 | Japan | 72/88 |
| 911460 | 11/1962 | United Kingdom | 72/469 |

*Primary Examiner*—Daniel C. Crane

*Attorney, Agent, or Firm*—Cushman, Darby & Cushman

[57] ABSTRACT

A thread rolling apparatus has thread rolling dies mounted respectively on a pair of sliding mechanisms which are vertically movably driven by respective actuators, and a support disposed between the thread rolling dies for rotatably supporting a workpiece. The sliding mechanisms and the support are interconnected by a rack and pinion mechanism for imparting a forced rotational drive force to the workpiece in synchronism with the movement of the sliders. The lead angle of the thread rolling dies is set to match the forced rolling diameter of the workpiece. By adjusting the distance between the thread rolling dies in matching relation to the workpiece diameter before threading, the thread rolling apparatus can form different screws having equal pitches and different nominal diameters.

9 Claims, 3 Drawing Sheets

THREAD ROLLING APPARATUS

This is a continuation of application Ser. No. 07/45,201, filed May 4, 1987, which is a continuation of Ser. No. 06/762,397, filed Aug. 5, 1985, both now abandoned.

BACKGROUND OF THE INVENTION

1. Field of the Invention

The present invention relates to an apparatus for forming external screw threads using flat dies, and more particularly to a thread rolling apparatus for producing a variety of screw threads of different characteristics using one type of thread rolling die.

2. Description of the Prior Art

In forming screw threads using thread rolling flat dies, it has been customary to prepare flat dies designed to meet the characteristics of the screw threads to be produced. These characteristics include thread size, spacing, shape, dimensions and screw diameter. The flat dies are then attached to a pair of sliding mechanisms which move in synchronism with each other in a thread rolling machine. A workpiece is positioned supported by a centering mechanism between the sliding mechanisms. These sliding mechanisms (sliding means) are then moved in a thread rolling direction so as to be pressed against the workpiece so that threads are cut in the workpiece.

With the above conventional method, however, the flat dies must be replaced with other flat dies when it is desired to form screw threads of different characteristics. Production of various screw threads has therefore required that thread rolling dies be replaced many times during the process. This has led to drawbacks in that the rate of production cannot be increased, and the cost of manufacturing screws is raised.

SUMMARY OF THE INVENTION

In response to this problem, it is an object of the present invention to provide an apparatus capable of forming various screw threads of equal pitches, but of a different nominal diameter of workpiece on a single type of thread rolling die.

According to the present invention, a thread rolling apparatus includes vertical guide members mounted on and along a pair of laterally spaced columns, sliding mechanisms mounted on these vertical guide members and vertically independently driven by respective actuators, and thread rolling dies mounted respectively on the sliding mechanisms and adjustable for varying the distance therebetween; a support means disposed between the thread rolling dies for rotatably supporting a workpiece, and a rack and pinion mechanism operatively connecting the support means to the sliding mechanisms, whereby a forced rotational drive force can be imparted to the workpiece in synchronism with the movement of the sliding means. The above-mentioned vertical movement of the sliding mechanisms by the actuators may also be performed by the horizontal movement of the sliding means.

Each of the thread rolling dies consists of a flat die having a raised longitudinally central portion and tapered end portions, one of the tapered end portion having a group of lead-in teeth on its upper surface, the raised central portion having a group of finishing teeth on its upper surface, and the other tapered end portion having a group of release teeth on its upper surface.

The lead angle of the thread rolling dies is set to match the forced rolling diameter of the workpiece irrespective of the diameter thereof before threading. As a result, the thread rolling dies slip with respect to the workpiece during the thread rolling process so as to enable the workpiece to approach a lead angle matching the characteristics of a desired product, so that a screw of normal shape will finally be produced. For producing two screws having substantially identical pitch but different diameters, only the distance between the thread rolling dies need be varied. Therefore, various screw threads of equal pitches and differing nominal diameters can be produced by one type of thread rolling dies. The number of thread rolling dies to be kept for ready use and the number of steps for replacing the thread rolling dies can accordingly be reduced, with the consequences that the rate of production of screws will be increased and the cost of manufacture of screws will be lowered.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
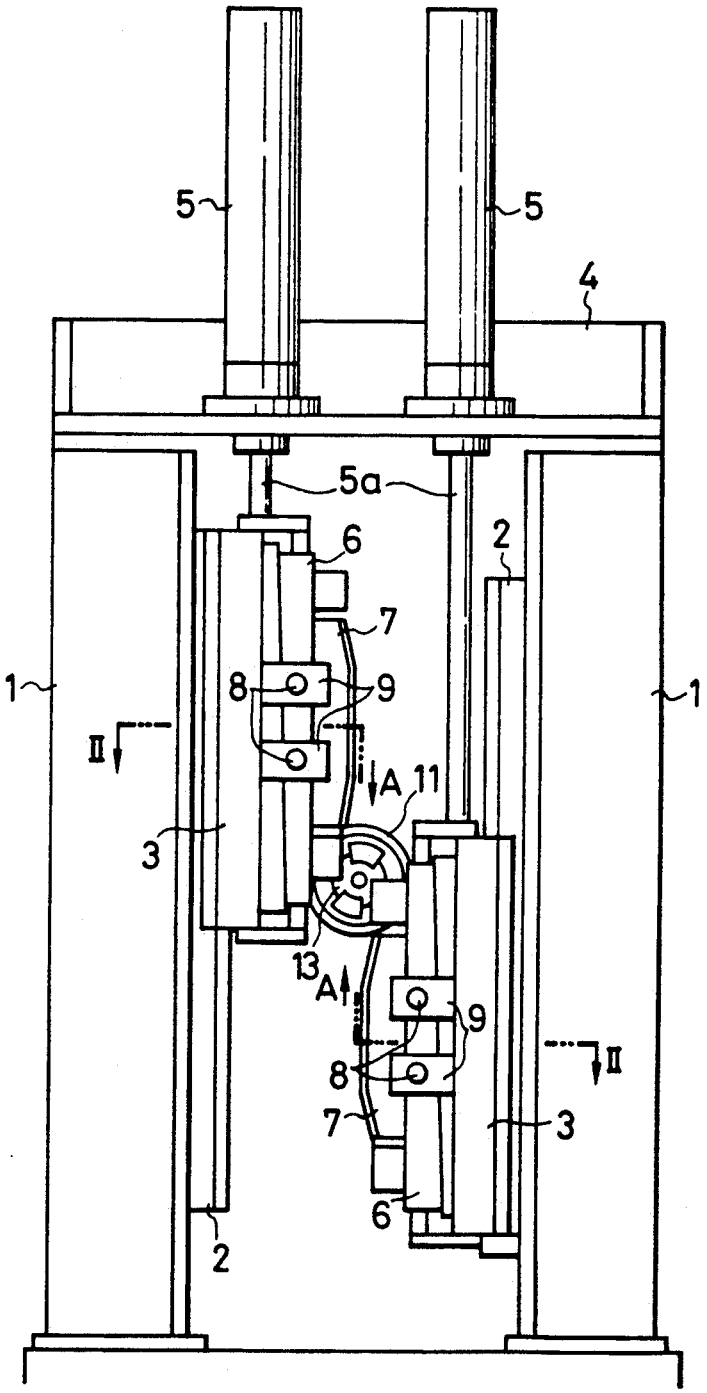
FIG. 1 is a front elevational view of a thread rolling apparatus according to the present invention.
Figure 2:
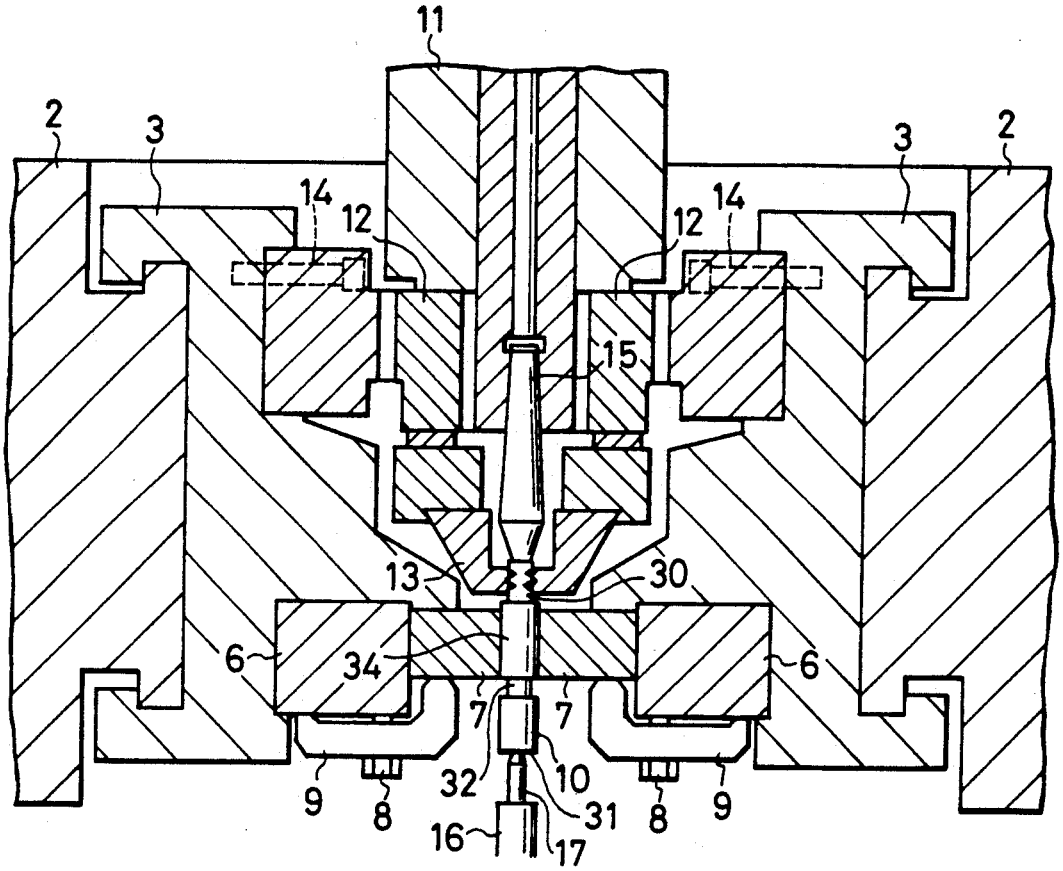
FIG. 2 is a cross-sectional view taken along line II—II of FIG. 1.
Figure 3:
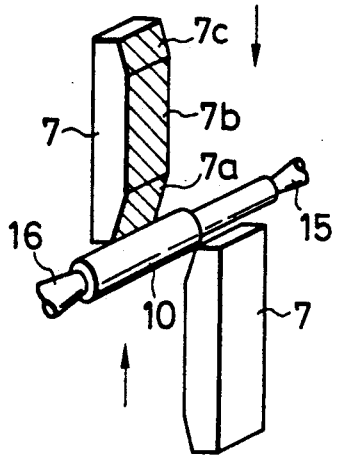
FIG. 3 is a perspective view of a pair of thread rolling dies in the thread rolling apparatus.

As shown in FIGS. 1 to 3, a thread rolling apparatus according to the present invention includes a pair of laterally spaced columns 1 to which a pair of vertical guide members 2 are fixed, respectively, on and along the inner side surfaces of the columns 1. A sliding mechanism 3 is movably mounted so that it can travel in a vertical direction along each of the vertical guide members 2. The sliding mechanisms 3 are connected to the output shafts 5a of a pair of actuators 5. These actuators 5 are fixedly mounted on a mount base 4, which is joined transversely to the upper ends of the columns 1. Thus, the sliding mechanisms 3 can move upwardly and downwardly along the vertical guide members 2 under control of the actuators 5.

A thread rolling die 7 is attached by a wedge means 6 to each sliding mechanism 3. Specifically, clamp means 9 are attached by bolts 8 to sliding mechanism 3. By threading bolts 8 through wedge means 6 and into sliding mechanism 3, wedge means 6 and thread rolling dies 7 are securely anchored between sliding mechanisms 3 and clamp means 9. The distance between thread rolling dies 7 can thus be varied by appropriately selecting the position of wedge means 6 with respect to sliding mechanisms 3, so that thread rolling dies 7 can form screw threads of varying characteristics, as described herein.

Referring to FIG. 2, main shaft 11 is positioned in between columns 1, and extends in a direction normal to the plane joining thread rolling dies 7. Main shaft 11 serves as a support means for a workpiece 10 as described herein. A synchronous pinion 12 is rotatably mounted on the distal end of the main shaft 11. Secured to the synchronous pinion 12 is a chucking mechanism 13 which grips the chucked portion 30 of workpiece 10. Synchronous racks 14 for meshing with the synchronous pinion 12 are attached to sliding mechanisms 3 thus forming a rack and pinion drive train. When sliding mechanisms 3 are moved upwardly and downwardly in a tangential direction to the workpiece, by actuators 5, the drive force imparted to sliding mechanisms 3 is transmitted through synchronous racks 14 and synchronous pinion 12 as a rotational drive force to chucking mechanism 13. Chucking mechanism 13, which holds chucked portion 30 of workpiece 10, is thus forcibly rotated, thus effectively rotating workpiece 10.

The apparatus also includes a tail stock 16 butted against head 31 of workpiece 10 with its center portion 17. Above the portion of workpiece 10 against which center portion 17 contacts is a narrow portion 32 of workpiece 10. Superjacent to narrow portion 32 is portion to be processed 34. The distal end of workpiece 10 (chucked portion 30) is held by chucking means 13. Centering means 15 is rotatably disposed in main shaft 11, and tail stock 16 which is movable toward and away from the main shaft 11 in coaxially confronting relation thereto. Centering means 15 and tail stock 16 also jointly serves as a support means for positioning the workpiece 10 in a desired position.

FIG. 3 shows a pair of thread rolling dies 7. Each of these thread rolling dies 7 consists of a flat die, having a raised central portion, and tapered end portions. One of the tapered end portions has a group of lead-in teeth 7*a* on its upper surface. The raised central portion has a group of finishing teeth 7*b* on its upper surface, and the other tapered end portion has a group of release teeth 7*c* on its upper surface.

Figure 4:
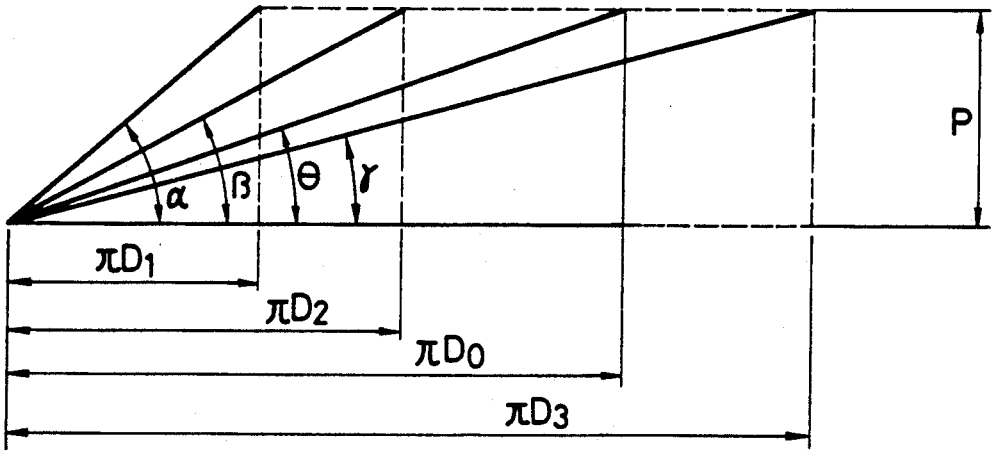
FIG. 4 is a diagram explaining a process for setting the lead angle of the thread rolling dies.

The thread rolling dies 7 in accordance with the present invention are adapted to have their lead angles set to match differing forced rolling diameters of workpiece 10 (thereby matching differing screw diameters). As an example, referring to FIG. 4, different screw diameters before threading are denoted as $D_1$, $D_2$, and $D_3$, with a constant screw pitch P. The screws $D_1$, $D_2$ and $D_3$ have lead angles, $\alpha$, $\beta$, and $\psi$ respectively. It is assumed that the chucked portion of the workpiece 10 has an outside diameter of $D_0$. Thus, the screw pitch P is selected with respect to the rolling diameter of $D_0$, with $\theta$ being the angle of inclination according to the relation:

$$\theta = \tan^{-1}\left(\frac{P}{\pi D_0}\right)$$

The thread rolling dies 7 are all initially set to this lead angle of $\theta$ irrespective of the screw diameters (dimensions) before threading.

When screw threads are to be formed, the wedge means 6 are appropriately selected to be in a position for bringing the distance between thread rolling dies 7 into matching relation to the screw characteristics. Then, chucked portion 30 of workpiece 10 is clamped between the centering means 15 and tail stock 16 and is held by the chucking mechanism 13. The thread rolling dies 7 are initially spaced apart in a thread rolling direction as shown in FIG. 1. When actuators 5 are engaged, sliding means 3 and hence thread rolling dies 7 are moved in the directions of the arrows A (in FIG. 1) and thus form screw threads on the workpiece 10.

As sliding mechanisms 3 are advanced (moved in direction A), the drive force imparted thereto is transmitted through synchronous racks 14 and synchronous pinion 12 as a rotational drive force to the chucking mechanism 13. Thus, workpiece 10 is forcibly rotated. Therefore, different diameter workpieces area rotated at the same angular velocity, with the result that the peripheral speed of the different diameter workpieces 10 vary with respect to thread rolling dies 7.

During such an operation, the thread rolling dies 7 are caused to slip with respect to the workpiece 10 so as to enable the screw being forced to approach a lead angle ($\alpha$ for example) matching the characteristics of the product, so that a screw of normal shape will finally be produced. That is, as the forming threads of the present invention is a kind of cold forming, if the peripheral speed of the portion to be processed of the workpiece is smaller or larger than the moving speed of the dies, there occurs a mutual slip between them resulting in various lead angles which are predetermined by the diameter of the portion to be processed.

In other words, the r.p.m. of the workpiece is determined automatically by the r.p.m. of the chuck, therefore the lead angle is changed owing to the diameter of the portion of being processed, i.e. the peripheral speed.

Since the workpiece 10 is forcibly rotated at its chucked diameter and the lead angle is determined without regard to the diameter before threading, various screws having equal pitches and different nominal diameters, i.e., different diameters before threading ($D_2$, $D_3$ for example) can be formed simply by changing the position of wedge means 6 with respect to sliding means 3, thereby varying the distance between thread rolling dies 7. Therefore, a wide variety of screws can be produced by the same thread rolling dies.

For example, the thread rolling apparatus can produce screws such as $\frac{1}{4}$- 20, 5/16 - 20 and $\frac{3}{8}$- 20 from a single die.

While the wedge means (depicted as wedges) have been employed to vary the distance between the thread rolling dies 7, shims of simple shape may instead be disposed on the back surfaces of thread rolling dies 7 for varying the distance therebetween. The clamp means 9 may be replaced with another means for clamping the wedge 6 and the companion thread rolling die 7.

Although a certain preferred embodiment has been shown and described, it should be understood that many changes and modifications may be made therein without departing from the scope of the appended claims.

What we claim is:

1. An adjustable thread rolling apparatus, comprising:

at least two die means, spaced from one another, for forming threads in a workpiece and for allowing a slip between said at least two die means and said workpiece so that the lead-in angle of said threads formed on said workpiece is determined by a diameter of said workpiece;

wedge means, coupled to said at least two die means, for adjusting a relative distance of said die means from one another;

sliding means, coupled to said die means, for moving said die means in such a way that a plane formed by the movement of said die means is substantially tangential to said workpiece; and means for rotating said workpiece in synchronism with said movement of said die means, so that a peripheral speed of said workpiece depends on workpiece diameter, said slip between said die means and said workpiece thus also being dependent on said workpiece diameter.

2. An apparatus as in claim 1 wherein each of said die means is a flat die having a longitudinally raised central portion, and two tapered end portions.

3. A thread rolling apparatus comprising:

at least two column means spaced from one another for supporting said apparatus;

vertical guide member means, coupled to said column means, for mounting on and along said column means;

sliding means, coupled to said vertical guide member means, for movably mounting on said vertical guide member means;

actuator means, attached to said sliding means, for driving said sliding means vertically along said vertical guide member means;

at least two thread rolling die means, attached to said sliding means, for forming threads on a workpiece while allowing a slip between said die means and said workpiece;

wedge means, mounted on said sliding means between said sliding means and said thread rolling die means, for varying the distance between said at least two thread rolling die means;

support means, disposed between said thread rolling die means, for supporting a workpiece and for rotating along with said workpiece; and rack and pinion means for operatively connecting said support means to said sliding means to rotate said support means in synchronism with said sliding means, whereby workpieces of different diameters will be rotated at substantially the same angular velocity and at substantially different surface velocities.

4. A thread rolling apparatus according to claim 3, wherein each of said thread rolling die means is of the flat die type and has successive groups of lead-in, finishing and release teeth.

5. A thread rolling apparatus according to claim 3 wherein each of said thread rolling dies has a lead angle set to match the forced rolling diameter of said workpiece.

6. A thread rolling apparatus according to claim 3 wherein said support means comprises a main shaft having a centering means for holding said workpiece in centered relation to said main shaft, a tail stock disposed in coaxially confronting relation to said main shaft, and a chucking mechanism mounted on said main shaft.

7. A thread rolling apparatus according to claim g wherein said chucking mechanism is connected to said rack and pinion means.

8. A thread rolling apparatus according to claim 6 wherein said rack and pinion means has racks fixed to said sliding means, and a pinion rotatably mounted on said main shaft.

9. An apparatus for producing threads on a plurality of different workpieces of different diameters, comprising:

at least two die means spaced from one another, for forming threads on any of said workpieces;

means, coupled to said die means, for moving said die means in a direction tangential to any of said workpieces; and means, operatively disposed with respect to said die means, for rotating any of the plurality of workpieces between and die means in synchrony with said moving of said die means, such that different ones of said workpieces are rotated at the same angular velocity whereas peripheral speeds of different ones of said workpieces are different, and are different from said die moving speed, to cause slip between said die means and said workpieces, and thereby cutting threads on said workpieces at a constant pitch for all workpiece diameters, lead angles of threads forming thereon depending on rolling diameters of said workpieces, in order to maintain pitch constant and independent of workpiece diameter.

* * * * *